United States Patent [19]

Mansson

[11] 4,236,478

[45] Dec. 2, 1980

[54] DRIVE INSTALLATION IN BOATS

[75] Inventor: Staffan T. Mansson, Hjalteby, Sweden

[73] Assignee: Ab Volvo Penta, Gothenburg, Sweden

[21] Appl. No.: 842,960

[22] Filed: Oct. 17, 1977

[30] Foreign Application Priority Data

Nov. 4, 1976 [SE] Sweden ..... 7612301

[51] Int. Cl.[3] ..... B63H 1/14; B63H 5/06

[52] U.S. Cl. ..... 440/112; 115/41 R; 114/269

[58] Field of Search ..... 115/34 RA, 35, 17, 18 R, 115/41 R; 114/269; 277/207 A, 168; 248/640, 3, 4, 18, 26, 358 R

[56] References Cited

U.S. PATENT DOCUMENTS

| | | | |
|---|---|---|---|
| 2,885,990 | 5/1959 | Hawthorne | 115/41 R |
| 2,977,923 | 4/1961 | Bergstedt | 115/34 R |
| 3,010,422 | 11/1961 | Brakensiek | 115/34 R |
| 3,107,922 | 10/1963 | Nathan | 277/168 |
| 3,171,382 | 3/1965 | Bergstedt | 115/34 R |
| 3,324,821 | 6/1967 | Laughlin | 115/34 R |
| 3,396,974 | 8/1968 | Nord | 277/207 A |
| 3,669,057 | 6/1972 | Shimanckas | 115/34 R |
| 4,040,378 | 8/1977 | Blanchard | 115/34 R |

FOREIGN PATENT DOCUMENTS

| | | |
|---|---|---|
| 51693 | 3/1943 | France . |
| 1196790 | 11/1959 | France . |
| 1203992 | 1/1960 | France . |

*Primary Examiner*—Trygve M. Blix
*Assistant Examiner*—D. W. Keen
*Attorney, Agent, or Firm*—Arthur G. Yeager

[57] ABSTRACT

A drive assembly in boats is disclosed, comprising a drive assembly with motor and an inboard-outboard drive coupled to the motor, and a motor bed, which has a passage, through which the assembly extends and which is aligned with a hole in the bottom of the boat, through which the assembly extends. The assembly has an elastic sealing ring which is held pressed between the wall of the passage and the outer surface of the assembly.

16 Claims, 4 Drawing Figures

DRIVE INSTALLATION IN BOATS

Figure 1:
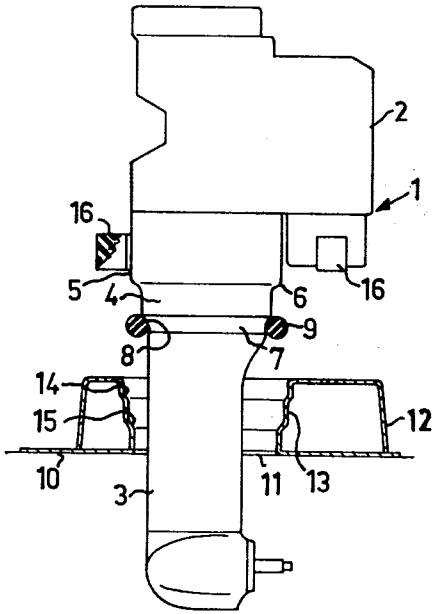

The present invention relates to a drive installation in boats, comprising a drive assembly with motor, and an inboard-outboard drive coupled to the motor, and a motor bed, which has a passage, through which the assembly extends and which is aligned with a hole in the bottom of the boat through which the assembly extends.

Drive installations of the above type are most common in sailboats having fin keel. One advantage of such installations is, among other things, that the drive assembly is simpler to install than, for example, a conventional inboard motor. Furthermore, the motor can be rubber mounted for silent and vibrationless operation without the necessity of flexible couplings between the motor and propeller shaft.

To prevent leakage through the hole in the bottom of the boat, a seal is required between the edge of the hole and the drive assembly. A known seal for this purpose is a rubber bellows, which, with the aid of clamp rings, is fastened onto a flange on the drive assembly and onto a flange on the motor bed or the bottom of the boat. Such a seal is relatively expensive, space consuming and complicated to mount. It is also unsatisfactory from the point of view of safety to only have a thin rubber bellows as the sole barrier for keeping out water.

The present invention intends to remove the abovementioned disadvantages and achieve a drive installation which is compact, easily mounted and inexpensive, and which also fulfills strict safety requirements.

This is achieved according to the invention by an elastic sealing ring being held pressed between the wall of the passage and the outer surface of the assembly.

The invention eliminates the need to mount special clamp rings, thereby making mounting simple. The seal is not sensitive to external damage since the material in the sealing ring is both thick and lies well protected between the motor bed and the assembly.

An additional very important advantage achieved by the invention is that the sealing ring will, to a significant degree, take the load off the motor's elastic mounting members from horizontal propeller thrust forces during operation. These forces can, when the motor is a gasoline engine and the drive assembly is consequently relatively light, amount to 3–5 times the weight of the assembly. This has previously caused significant problems, since the mounting members of the motor, which are usually rubber cushions, must be soft and must allow a static resilience downward of two to four mm under the weight of the drive assembly in order to give good vibration insulation against excitation forces.

These soft cushions, which were previously subjected to undesirable shearing, because of the horizontal propeller thrust, are only subjected, as a result of the insertion of the sealing ring, essentially to pulling or pushing, while the previous shearing stresses are absorbed as compressive forces by the sealing ring. In addition to functioning as a sealing member, the ring thus also functions as a vibration dampening member in cooperation with the rubber cushions.

Figure 2:
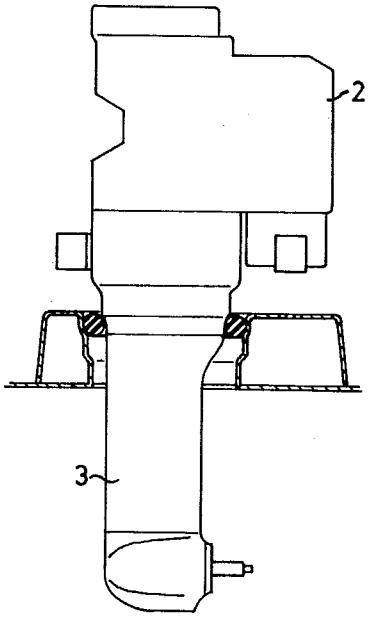
Figure 3:
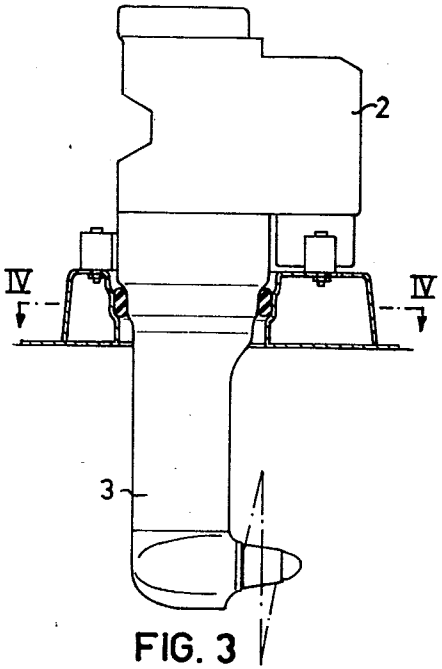
Figure 4:
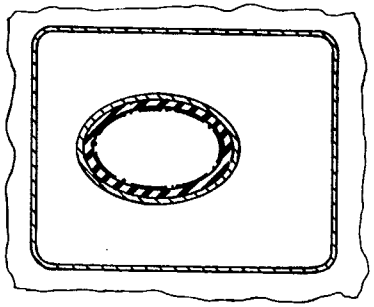

Other characteristics and advantages of the invention will be presented in the following description, with reference to the accompanying drawing showing examples, in which FIGS. 1–3 show schematically various steps in the mounting of the drive assembly in an installation according the invention, and FIG. 4 shows a section along the line IV—IV in FIG. 3.

The drive assembly shown (generally designated 1) consists of a motor unit 2 and an inboard-outboard drive unit 3. In the embodiment shown, the motor 1 has horizontal cylinders and consequently a vertical crankshaft, and thus the shaft of the drive is coupled to the crank shaft without an intermediate angle gear. Both the motor 2 and the drive 3 can be of known design per se, as regards the mechanical construction, and therefore the figures are quite simplified and only show essential features to illustrate the invention.

The casing of the inboard-outboard drive 3 has at its upper end a portion 4 with reduced cross-section in relation to a portion 5 of the motor unit 2 to which the drive casing is attached, so that a step 6 is formed at the transition between the motor unit 2 and the drive 3. The portion 4 can have an elliptical cross section for example, as shown in FIG. 4. Below the portion 4 there is a portion 7 with reduced cross-section in relation to portion 4, so that an additional step 8 is formed at a distance from the first step 6. An O-ring gasket 9 of elastic material, e.g. rubber, is forced over the portion 7 in FIG. 1. The upper part of the O-ring gasket 9 abuts the step 8. The O-ring 9 is designed so that it exerts a certain pressure against the surface of portion 7.

In the figures, 10 designates a part of the bottom of a boat hull, e.g. the part which lies between a fin keel and a rudder on a sailboat hull, which the installation according to the invention is especially intended for. There is a hole 11 in the bottom 10 and on its inside a motor bed 12 is arranged, which consists, for example, of moulded fiberglass reinforced plastic and is securely moulded to the bottom. The motor bed has a passage 13, which is aligned with the hole 11. The passage has a cross-sectional shape corresponding to the cross-sectional shape of portions 4 and 7 of the drive casing and its cross-sectional area diminishes stepwise downwards, so that two steps 14 and 15 are formed in its wall between downwardly extending sections.

FIG. 1 illustrates how the assembly 1 as the mounting is begun is inserted down through the passage 13 and the hole 11. In FIG. 2 the assembly has reached a position in which it rests, via the ring 9 on the upper step 14 of the passage. From this position the assembly is forced downwards to its final position shown in FIG. 3, whereby the ring 9 rolls up on portion 4 of the drive casing into abutment with step 6 at the same time as it rolls down to step 15 of the passage. Thus the ring 9 is deformed outwards as well as inwards, so that an effective seal is assured. The ring and the elliptical cross-section cause the assembly to be centered in the correct position in relation to the motor bed 12, so that the assembly can thereafter be simply fastened to the motor bed via conventional elastic vibrations-dampening members, rubber cushions 16 for example.

It is evident from the above that the embodiment according to the invention greatly facilitates the installation of the drive assembly.

The invention is of course not limited to a drive assembly with a vertical motor crank shaft but also encompasses a drive assembly of the more usual type with a horizontal motor crank shaft and an inboard-outboard drive with the input shaft coupled to an angle gear.

What I claim is:

1. In combination in a boat having an opening in its bottom, an inboard engine, an upright drive leg fixed to said engine, means fixedly mounting said engine in said boat with said leg extending downwardly through said opening, said leg having a propeller shaft at its lower end portion disposed spacedly below said bottom, an upstanding collar fixed to and extending upwardly from said bottom and sealed to said bottom continuously around said opening, said collar being interiorly tapered to increase in interior cross-sectional dimensions upwardly of said opening, said leg being disposed aligned in said collar, extending upwardly above and downwardly below said collar and having an intermediate portion located within said collar, said intermediate portion tapering downwardly and conformingly to said interior of said collar and being spaced within said collar, an O-ring seal interiorly expanded tightly around said intermediate portion and exteriorly squeezed within said collar, said interior of said collar including an inward step against which the lower portion of the O-ring seal abuts in the installed state of the assembly, the outer surface of said intermediate portion including a corresponding outwardly extending step which abuts the upper portion of the O-ring in said installed state, said collar having a section of said interior extending upwardly from said inward step and said intermediate portion having a section extending downwardly from said outwardly extending step, which said sections are substantially upright and untapered and between which said O-ring is so squeezed.

2. The combination according to claim 1 characterized in that the interior of said collar and the exterior of said intermediate portion are elliptical in cross-section.

3. The combination according to claim 1 characterized in that said tapered interior includes an additional inward step spacedly above said first inward step and that said intermediate portion is provided spacedly below said corresponding step with an additional outwardly extending step.

4. In combination in a boat having an opening in its bottom and an upright drive leg for extending downwardly through said opening and having a propeller shaft at its lower end portion for disposition under said bottom, an upstanding collar fixed to and extending upwardly from said bottom of the boat and sealed to said bottom continuously around said opening, said collar being interiorly tapered to increase in interior cross-sectional dimensions upwardly of said opening, said leg being disposed aligned in said collar, extending upwardly above and downwardly below said collar and having an intermediate portion located within said collar, said intermediate portion tapering downwardly and conformingly to said interior of said collar and being spaced within said collar, an O-ring seal interiorly expanded tightly around said intermediate portion and exteriorly squeezed within said collar, said collar comprising an outwardly extending integral upper end flange, and a plurality of mounting pads attached to said leg and disposed outwardly of and upwardly adjacent said intermediate portion for leg supporting engagement with said flange.

5. The combination according to claim 4 characterized in that said collar has an interior step engageable under, and said intermediate portion has an exterior step engageable downwardly on, said O-ring seal when said drive leg is in installed position in said collar.

6. The combination according to claim 4 characterized in that said collar is of moulded fiber reinforced plastic material mouldedly secured to said bottom.

7. A bed member for mounting a drive leg through a hole in the bottom of a boat, comprising a generally horizontal annular upper panel portion having an inner edge and an outer edge, a continuous outer wall portion integral with said panel portion extending downwardly from said outer edge and a continuous inner wall portion integral with said panel portion extending downwardly and inclinedly inwardly from said inner edge to define first and second downwardly extending sections for receiving such leg therethrough, and a sharply inwardly tapering wall section joining the lower portion of said first section and the upper portion of said second section.

8. A bed member in accord with claim 7 wherein said panel and wall portions are integrally moulded of fiberglass reinforced plastic material.

9. A bed member in accord with claim 8 wherein the cross-sectional shape of said passage is elliptical.

10. A bed member in accord with claim 7 wherein the cross-sectional shape of said passage is elliptical.

11. In combination, an inboard engine having an upright drive leg adapted to extend downwardly through an opening in the bottom of a boat and having a propeller shaft at its lower end portion for disposition under said bottom, means fixedly mounting said engine in said boat, an upstanding mounting collar for said leg adapted to be disposed above and sealingly engaged on such boat bottom and to extend continuously around such opening, said collar having an inner wall surface tapered to provide a passage decreasing in cross-sectional dimensions downwardly toward such boat bottom, said leg being disposably aligned in said passage to extend upwardly above and downwardly below said collar and said leg having an intermediate portion location within said collar when said leg is so disposed, said intermediate portion tapering downwardly and conformingly to said inner wall surface and being spaced within said collar, an O-ring seal interiorly expanded tightly around said intermediate portion and exteriorly squeezed within said collar when said leg is so disposed, said collar having an interior step engageable under, and said intermediate portion having an exterior step engageable downwardly on, said O-ring seal to squeeze same when said drive leg is in its installed position in said collar.

12. The combination according to claim 11 wherein said collar is of moulded fiber reinforced plastic.

13. The combination according to claim 11 wherein said passage and said intermediate portion are elliptical in cross-section.

14. In combination, an upright drive leg adapted to extend downwardly through an opening in the bottom of a boat and having a propeller shaft at its lower end portion for disposition under said bottom, an upstanding mounting collar for said leg adapted to be disposed above and engaged on such boat bottom and to extend continuously around such opening, said collar having an inner wall surface tapered to provide a passage decreasing in cross-sectional dimensions downwardly toward such boat bottom, said leg being disposably aligned in said passage to extending upwardly above and downwardly below said collar and said leg having an intermediate portion located within said collar when said leg is so disposed, said intermediate portion tapering downwardly and conformingly to said inner wall surface and being spaced within said collar, an O-ring seal interiorly expanded tightly around said intermediate portion and exteriorly squeezed within said collar when said leg is so disposed, said collar including an outwardly extending integral upper end flange, and a plurality of mounting pads attached to said leg and disposed outwardly of the upper end of said intermediate portion for leg supporting engagement with said flange.

15. The combination according to claim 14 wherein said collar is hollow and is of moulded fiber reinforced plastic.

16. The combination according to claim 14 wherein said passage and said intermediate portion are elliptical in cross-section.

* * * * *